United States Patent [19]

Griffin et al.

[11] 4,241,323

[45] Dec. 23, 1980

[54] REFLECTIVE DUAL MODE FILTER

[75] Inventors: Edward L. Griffin; Frederick A. Young, both of Huntington Beach, Calif.

[73] Assignee: Hughes Aircraft Company, Culver City, Calif.

[21] Appl. No.: 55,109

[22] Filed: Jul. 5, 1979

[51] Int. Cl.[3] ..... H01P 1/208; H01P 7/06; H01P 1/16

[52] U.S. Cl. ..... 333/209; 333/21 A; 333/212; 333/248

[58] Field of Search ..... 333/208-212, 333/209-226, 248, 245, 239, 21 R, 21 A, 129

[56] References Cited

U.S. PATENT DOCUMENTS 4,060,779 11/1977 Atia et al. ..... 333/21 A X

OTHER PUBLICATIONS

Cameron et al.-"The Analysis, Synthesis and Multiplexion of Bandpass Dual-Mode Filters", ESA Journal, vol. 1, No. 2, 1977; pp. 177-188.

*Primary Examiner*—Marvin L. Nussbaum

*Attorney, Agent, or Firm*—William H. MacAllister; John Holtrichter, Jr.

[57] ABSTRACT

A waveguide filter is herein described that employs a resonator ordering which allows a direct realization of all canonical couplings while retaining the advantages of a standard dual mode filter, the filter including a reflective plate in one end cavity and both input and output ports in the other end cavity, where one of the ports is a shunt port in a sidewall of the cavity structure and the other port is a coupling slot in the outer end wall.

11 Claims, 9 Drawing Figures

Fig. 1.
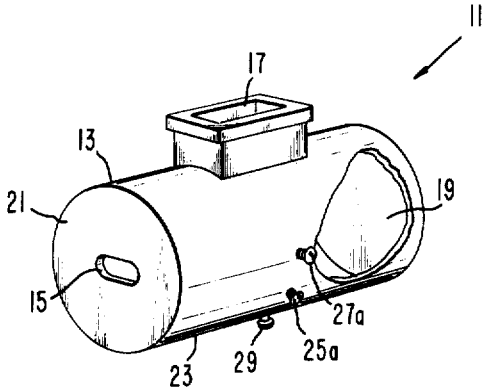
Fig. 9.
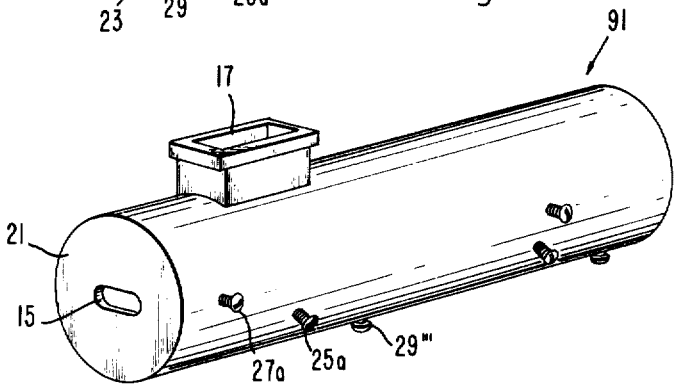
Fig. 5.
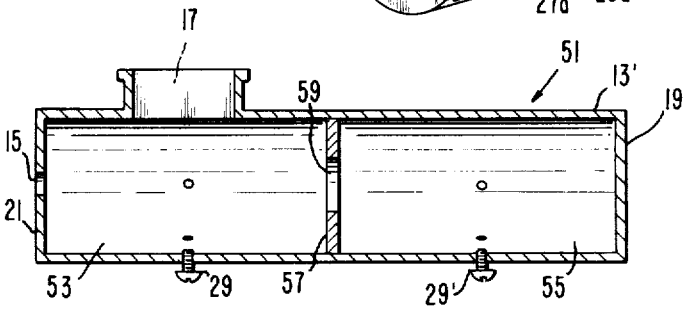
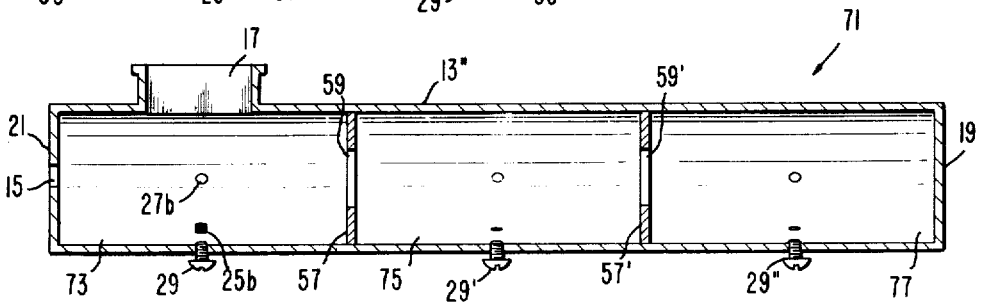
Fig. 7.

REFLECTIVE DUAL MODE FILTER

TECHNICAL FIELD

This invention relates to radio frequency filter devices, and more particularly, to waveguide filters utilizing cavities supporting two orthogonal modes and a reflective end plate.

BACKGROUND ART

Standard dual mode filters do not realize all canonical bridge couplings. Also, these standard filters have large bridge coupling dispersion which can cause difficulty in structures with external bridges. In working to overcome this shortcoming, a canonical dual mode filter was developed and described in U.S. Pat. No. 4,060,779.

This patent concerns a plural cavity waveguide filter comprising a plurality of cascaded waveguide cavities each resonating in first and second independent orthogonal modes. The cavities may be either square and/or circular resonating in the $TE_{101}$ or $TE_{111}$ modes, respectively, and it is possible to realize the general class of coupled cavity bandpass transfer filter functions by providing that the input and output couplings to the filter be physically connected to the first physical cavity.

Although both the input and output filter ports are connected to the same physical cavity, these ports are coupled to different orthogonally-oriented electrical cavities within the same physical cavity. Although, theoretically the design would seem to be complete, it has been found that certain distinct disadvantageous characteristics are present in the operation of the canonical dual mode filter described in the above-noted patent.

The main disadvantage of the prior art, exemplified for example by the above-referred to patent, lies in the difficulty of minimizing the leakage path between the input and output ports. Such leakage degrades the usefulness of the filter and adversely affects the ability to provide a generally desired symmetrical out-of-passband response. It should, therefore, be evident that an improved technique used in reflective dual mode filters to minimize the leakage path and symmetize the out-of-band rejection characteristic, would constitute a significant advancement in the art.

SUMMARY OF THE INVENTION

In view of the foregoing factors and conditions characteristic of the prior art, it is a primary object of the present invention to provide an improved reflective dual mode filter.

Another object of the present invention is to provide a reflective dual mode filter having a balanced mode coupling tuning system.

Still another object of the present invention is to provide a reflective dual mode filter having a balanced cavity tuning system.

In accordance with one embodiment of the present invention, a reflective dual mode filter includes at least one waveguide cavity resonating at its resonant frequency in a first and a second independent orthogonal mode, and first coupling means is provided in the cavity for intra cavity coupling of the first mode to the second mode. A reflective plate is provided in the cavity, and a shunt port in a side wall and a coupling slot port in the other end wall are also provided. The invention also comprises a pair of balanced coupling screws as part of the first coupling means, the balanced coupling screws being oriented about the axis of the cavity 90 degrees with respect to one another and 45 degrees with respect to a plane through the longitudinal axis of the waveguide cavity and through the shunt port.

The invention may further comprise a plurality of the waveguide cavities, each resonating in the first and the second independent orthogonal modes, the ports being disposed in a first of the waveguide cavities and the reflective plate being disposed at the outer extremity of the one of the waveguide cavities at the end of the filter opposite the first of the waveguide cavities. The invention may further comprise second coupling means connecting successive ones of the cavities for inter cavity coupling like oriented modes in the successive cavities. In accordance with embodiments of the invention, the waveguide cavity or cavities may be circular and supporting first and second independent orthogonal $TE_{111}$ modes, or the waveguide cavity or cavities may be rectangular and supporting first and second independent orthogonal $TE_{101}$ modes. Still further, the balanced coupling screws may be oriented about the axis of the cavity 135 degrees with respect to the shunt port in the side wall, or they may be oriented about the axis of the cavity 45 degrees with respect to the shunt port.

The features of the present invention which are believed to be novel are set forth with particularity in the appended claims. The present invention, both as to its organization and manner of operation, together with further objects and advantages thereof, may best be understood by making reference to the following description taken in conjunction with the accompanying drawings in which like reference characters refer to like elements in the several views.

BRIEF DESCRIPTION OF THE DRAWINGS

FIG. 1 is a perspective view of a reflective dual mode filter constructed in accordance with one embodiment of the present invention;

FIG. 5 is a sectional view taken along the longitudinal axis of a reflective dual mode filter in accordance with still another embodiment of the present invention;

FIG. 7 is a sectional view taken along the longitudinal axis of still a further embodiment of the reflective dual mode filter in accordance with the present invention;

FIG. 9 is a perspective view of a reflective dual mode filter constructed in accordance with yet a further embodiment of the present invention.

DETAILED DESCRIPTION OF THE INVENTION

Figure 2:
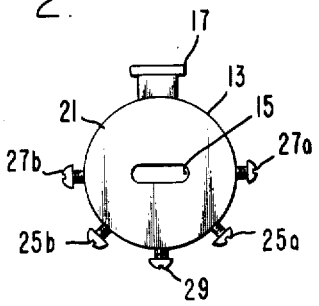
FIG. 2 is an end elevational view of the reflective dual mode filter of FIG. 1.

Referring now to the drawings and more particularly to FIGS. 1 and 2, there is shown a reflective dual mode filter 11 constructed using two linear orthogonal polarizations of $TE_{111}$ in circular waveguide 13. The waveguide 13 is provided with two ports, 15 and 17, and an energy reflecting end plate 19. Either of the ports may be the input port and the other will be the output port. In the various embodiments of the invention described herein, the input port will be the coupling slot 15 in the other end wall 21, and the output port is the shunt slot 17 in the sidewall 23.

The two orthogonal modes are supported in a single physical cavity which has two electrical sections. Coupling between the modes is provided by a pair of balanced coupling screws **25*a* and 25*b* oriented about the axis of the waveguide, 90 degrees with respect to each other and 135 degrees with respect to the shunt slot port 17 in the side wall 23 of the waveguide 13. Likewise, balanced cavity tuning screws 27*a* and 27*b* are provided about the axis of the waveguide, 180 degrees with respect to each other and 90 degrees with respect to the shunt slot port 17 in order to capacitively tune the cavity to a desired operating frequency with respect to one of the orthogonal modes, while a single tuning screw 29, positioned 180 degrees with respect to the shunt slot port 17** is provided to capacitively tune the other of the orthogonal modes.

Figure 3:
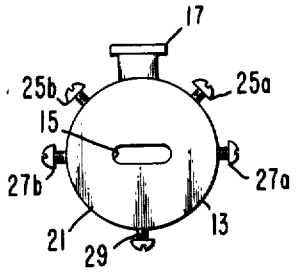
FIG. 3 is an end elevational view of the reflective dual mode filter in accordance with another embodiment of the present invention.
Figure 4:
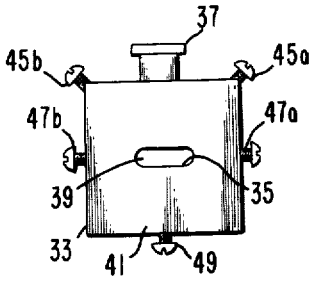
FIG. 4 is an end elevational view of a reflective mode filter similar to the embodiment of FIG. 3 but in a rectangular waveguide structure.

In accordance with another embodiment of the invention, shown in FIG. 3, the orghogonal mode coupling screws **25*a* and 25*b* are positioned 45 degrees with respect to the output port 17 and 90 degrees with respect to each other. In rectangular guide, the invention is shown in FIG. 4 and consists of a rectangular waveguide 33 supporting two orthogonal $TE_{101}$ modes, and includes an input port 35, and an output port 37, a reflective plate 39, an end plate 41 and mode coupling and tuning screws 45 and 47** respectively, similar in operation to the first described embodiment of the invention.

In all embodiments of the invention, the coupling and tuning screws are positioned about the periphery of the structure midway between the end walls defining a physical cavity structure. This position is at an E field maximum and an I field minimum, as is the general practice in the art. And in all embodiments of the invention, the mode coupling screws are in balanced positions to minimize the leakage path and to symmetize the out-of-band rejection characteristic. The cavity tuning screws are also balanced, but in the waveguide section containing the input/output ports, the tuning screw located opposite the shunt slot port in the side wall must rely on the balancing effect provided by the two balanced coupling screws.

Figure 6:
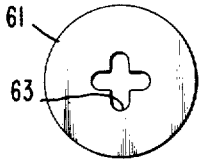
FIG. 6 is an elevational view of a section of a reflective dual mode filter utilizing crossed iris coupling slots between adjacent cavity structures in accordance with yet another embodiment of the present invention.

The embodiment of the invention shown in FIG. 1 provides two resonators in a single cavity structure and defines no loss poles. However, the invention may also be practiced utilizing a plurality of two orthogonal mode-supporting cavity structures, as shown in FIG. 5, for example. Here, a reflective dual mode filter 51 is shown having a first cavity structure 53 and a second cavity structure 55 separated and defined by an intermediate iris plate 57 including a circular iris opening 59 of conventional design. Alternately, an iris plate 61, as shown in FIG. 6, having a pair of crossed iris slots 63 may be utilized with similar results. In this embodiment, four resonators in two physical cavities are defined to provide two loss poles. The addition of loss poles provides lower loss and better rejection.

In yet another embodiment, presently preferred, there is shown in FIG. 7 a reflective dual mode filter 71 having six resonators, two in each cavity structure 73, 75 and 77, separated by iris plates 57 and 57'. The different embodiments of the invention shown in FIGS. 1, 5 and 7 follow the same basic design and function similarly, but each provides a different filter characteristic. Thus, the six resonator design of FIG. 7 provides six finite frequency loss poles, and by adding still another cavity structure (not shown), eight loss poles would be provided for even lower loss and better rejection and phase response characteristics.

Figure 8:
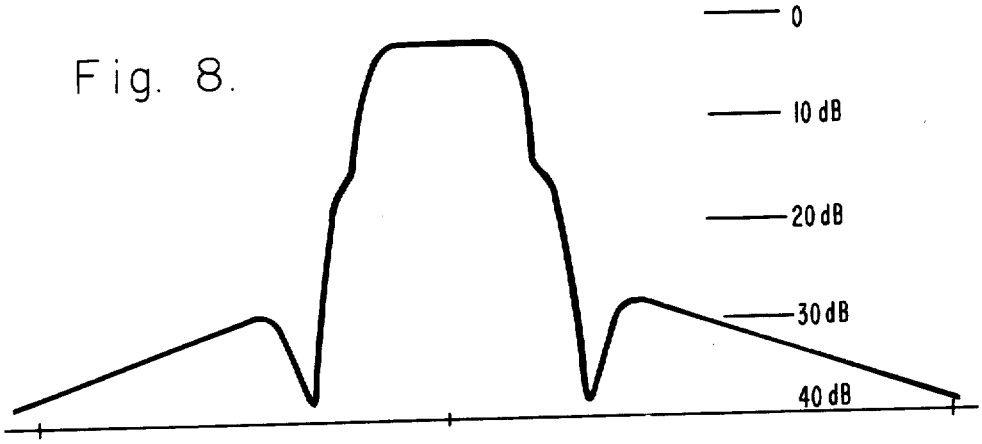
FIG. 8 is a graph showing the experimental response characteristics of the reflective dual mode filter having six sections with four loss poles, such as shown in FIG. 3.

In a construction of the six section reflective dual mode filter of FIG. 7 using orthogonal $TE_{111}$ modes in circular guide, the insertion loss of the filter is shown in FIG. 8. The bandwidth was found to be about 28 MHz centered at about 7 GHz. The response here has four finite loss poles, demonstrating that all canonical bridges are present.

From the foregoing, it can be seen that the input and output ports of the reflective dual mode filter according to the invention are located at the same end of the filter, coupling respectively into two orthogonal modes of the cavity. The non-folding mainline couplings are iris slots, and the bridge couplings and the folded mainline couplings are 45 degree screws. In all embodiments of the invention, the screw penetration determines the amplitude, and the screw orientation determines the coupling sign. The coupling screws are adjusted so that the net bridge couplings are between resonators, including stray coupling due to mechanical imperfections, are as required. For the six section filter of FIG. 7, the bridges are 1-6, 2-5, and coupling 3-4 is the folded mainline coupling.

For filters of six or more sections, the reflective dual mode filter design described herein can obtain more finite frequency loss poles than a standard dual mode filter, such as described by A. E. Williams in an article entitled "A Four-Cavity Elliptic Waveguide Filter," IEEE Mtt-18, December, 1970, pages 1109–1114.

Referring now to yet another embodiment of the invention, herein identified by reference numeral 91 in FIG. 9, it should be realized that higher order modes may be utilized in practicing the invention. Thus, $TE_{11n}$ mode filter sections, where n is an interger equal to or greater than 2, may be fabricated using well-known waveguide filter techniques. For example, the reflective dual mode filter 91 has orthogonal $TE_{113}$ modes in circular guide, and the balanced coupling screws 25', tuning screws 27' and 29'' are positioned generally midway between mode boundaries in the manner previously described in relation to the angular positions of 45, 90, 135 and 180 degrees.

It has been found that by testing the positions of the coupling and tuning screws at different modes within each section, leakage in some cases can be even more limited than when such screws are located in only one of the mode positions. This is true even though these positions in the different modes are nominally equivalent for the filter. The different coupling and tuning positions allow additional freedom for optimizing adjustments for minimum spurious leakage.

From the foregoing, it should be evident that there has herein been described an improved reflective dual mode filter having a balanced mode coupling and cavity tuning system, and which provides an improved minimum leakage path characteristic.

It should also be understood that the materials used to fabricate the various embodiments of the invention are not critical and any material exhibiting desired characteristics may be utilized.

Further, it should be realized that although the present invention has been shown and described with reference to particular embodiments, various changes and modifications obvious to one skilled in the art to which the invention pertains are deemed to be within the spirit, scope and contemplation of the invention.

What is claimed is:

1. A reflective dual mode filter including at least one waveguide cavity resonating at its resonant frequency in a first and a second independent orthogonal mode, first coupling means in said cavity for intra cavity coupling of said first mode to said second mode, a reflective plate provided in said cavity, and a shunt port in a side wall and a coupling slot port in the other end wall of said cavity, the improvement wherein said first coupling means includes a pair of balanced coupling screws oriented about the axis of said cavity 90 degrees with respect to one another and 45 degrees with respect to a plane through the longitudinal axis of said waveguide cavity and through said shunt port.

2. The reflective dual mode filter according to claim 1, comprising a plurality of said waveguide cavities, each resonating in said first and second independent orthogonal modes, said ports being disposed in a first of said waveguide cavities and said reflective plate being disposes at the outer extremity of the one of said waveguide cavities at the end of said filter opposite said first of said waveguide cavities, and also comprising second coupling means connecting successive ones of said cavities for inter cavity coupling like oriented modes in said successive cavities.

3. The reflective dual mode filter according to claim 1, wherein said waveguide cavity is circular and said first and second independent orthogonal modes are $TE_{111}$ modes.

4. The reflective dual mode filter according to claim 1, wherein said waveguide cavity is rectangular and said first and second independent orthogonal modes are $TE_{101}$ modes.

5. The reflective dual mode filter according to claim 1, wherein said coupling slot port is an input port, and wherein said shunt port is an output port.

6. The reflective dual mode filter according to claim 2, wherein said second coupling means includes an iris plate between each of said successive cavities and having a circular iris opening therein.

7. The reflective dual mode filter according to claim 2, wherein said second coupling means includes an iris plate between each of said successive cavities and having a crossed slot opening therein.

8. The reflective dual mode filter according to claim 1, wherein said balanced coupling screws are oriented about the axis of said cavity 135 degrees with respect to said shunt port in said side wall.

9. The reflective dual mode filter according to claim 1, wherein said balanced coupling screws are oriented about the axis of said cavity 45 degrees with respect to said shunt port in said side wall.

10. The reflective dual mode filter according to claim 2, wherein two of said resonant cavities are provided, each supporting said first and said second independent orthogonal modes and providing two loss poles or sections of equalization.

11. The reflective dual mode filter according to claim 2, wherein three of said resonant cavities are provided, each supporting said first and said second independent orthogonal modes and providing four loss poles.

* * * * *